US007237889B2

(12) United States Patent
Suzuki et al.

(10) Patent No.: US 7,237,889 B2
(45) Date of Patent: Jul. 3, 2007

(54) INK-JET RECORDING APPARATUS

(75) Inventors: Yoshiyuki Suzuki, Iruma (JP); Takeshi Yokoyama, Machida (JP)

(73) Assignee: Konica Minolta Medical & Graphic, Inc. (JP)

( * ) Notice: Subject to any disclaimer, the term of this patent is extended or adjusted under 35 U.S.C. 154(b) by 278 days.

(21) Appl. No.: 10/945,335

(22) Filed: Sep. 20, 2004

(65) Prior Publication Data

US 2005/0062822 A1 Mar. 24, 2005

(30) Foreign Application Priority Data

Sep. 24, 2003 (JP) ..... 2003-331905
Aug. 5, 2004 (JP) ..... 2004-229465

(51) Int. Cl.
*B41J 2/01* (2006.01)

(52) U.S. Cl. ..... 347/102; 347/101

(58) Field of Classification Search ..... 347/102, 347/101; 101/488; 219/216; 346/25; 399/320
See application file for complete search history.

(56) References Cited

U.S. PATENT DOCUMENTS 2,248,618 A * 7/1941 Fischer ..... 250/437
2,544,781 A * 3/1951 Doane ..... 362/217
2,769,897 A * 11/1956 Rzeszutko ..... 362/217
6,392,206 B1 * 5/2002 Von Arx et al. ..... 219/468.1
6,432,344 B1 * 8/2002 Eckman et al. ..... 264/263
6,696,802 B1 * 2/2004 Lezcano et al. ..... 315/248
2002/0139004 A1 10/2002 Laudat et al.
2003/0035037 A1 2/2003 Mills et al.
2003/0081098 A1 * 5/2003 Wotton et al. ..... 347/102
2003/0130374 A1 * 7/2003 Smith et al. ..... 523/160
2003/0222962 A1 * 12/2003 Hirai ..... 347/102

FOREIGN PATENT DOCUMENTS

JP 2001-310454 11/2001
JP 2003-145725 5/2003

OTHER PUBLICATIONS

English Abstract for JP 2001-310454. English Abstract for JP 2003-145725.
European Search Report for Application No. 04104477.7-2304 dated Jan. 19, 2005.
"Lamp Guide 2001", Lighting Industry Federation Limited, London, UK, Richard Forster (Editor).

* cited by examiner

*Primary Examiner*—Stephen Meier
*Assistant Examiner*—Leonard Liang
(74) *Attorney, Agent, or Firm*—Cantor Colburn LLP

(57) ABSTRACT

There is provided an ink-jet recording apparatus that can maintain a constant light emission intensity of a light source with a simple structure, and allows easy replacement of the light source, while realizing miniaturization and reduction in weight of the apparatus. The ink-jet recording apparatus includes a recording head to jet photocurable ink onto a recording medium, wherein the photocurable ink is cured by being exposed to light; and a light emitting device having a light source to emit light to cure the photocurable ink, the light source including a light emitting tube and metal caps provided at both ends of the light emitting tube, wherein the light emitting tube has a bent section.

10 Claims, 6 Drawing Sheets

FIG. 6 ( a )
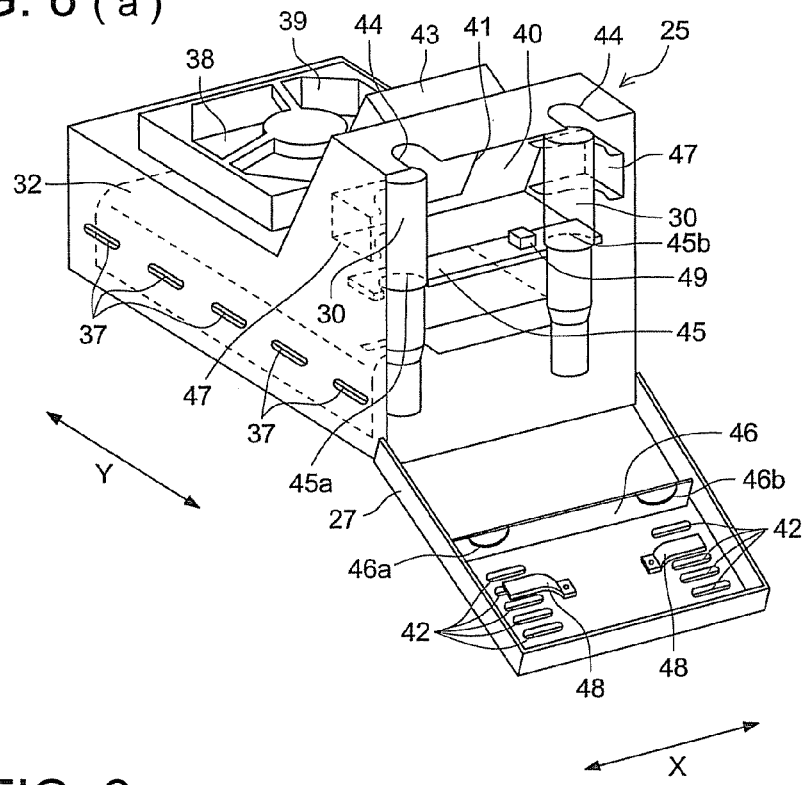
FIG. 6 ( b )
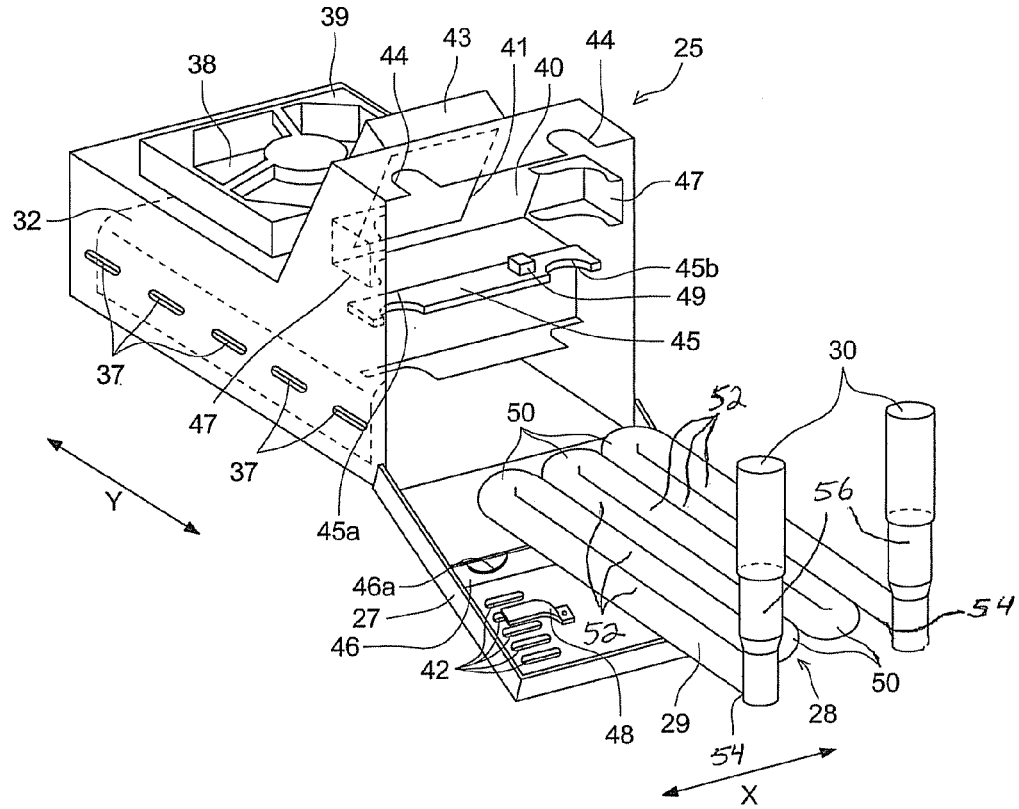

INK-JET RECORDING APPARATUS

FIELD OF THE INVENTION

The present invention relates to an ink-jet recording apparatus, and particularly relates to an ink-jet recording apparatus for recording an image by the use of photocurable ink that is cured by exposure to light.

BACKGROUND OF THE INVENTION

In general, as ink-jet recording apparatuses that flexibly respond to high-mix, low-volume demands, conventionally, ink-jet type ink-jet recording apparatuses are known. An ink-jet type ink-jet recording apparatus jets ink from nozzles provided on a surface of the recording head, the surface facing a recording medium, so that the ink impacts and fixes onto the recording medium, and thereby an image is recorded on the recording medium.

Recently, as ink-jet recording apparatuses applicable to various recording media, ink-jet recording apparatuses using photocurable type ink are known (for example, refer to Patent Document 1 and Patent Document 2). Each of these uses photocurable ink containing a photoinitiator having a predetermined sensitivity to light, and ink having impacted onto the recording medium is exposed to light, thus the ink is cured to be fixed on the recording medium. By such an ink-jet type ink-jet recording apparatus using photocurable ink, ink is instantly cured just after having impacted on to the recording medium and been exposed to light. Therefore, ink sinks into the recording medium or blots little, making it possible to record an image, not only onto a plain paper sheet, but also onto a recording medium of a material such as plastic-or metal, which does not absorb ink at all.

Such an ink-jet recording apparatus using photocurable ink requires jetted ink to be exposed to light of an intensity that is great enough to properly cure and fix the ink. To meet this requirement, in recent years, there has been offered cation-curable ink that accumulates energy and can be cured by exposure to light of even low illumination intensity if the exposure is performed for a long time. To cure this cation-curable ink, a low-pressure mercury lamp or an ultraviolet light source of a low electric power and low output power, such as a cold-cathode tube, can be utilized. Even in the case of using such an energy accumulating ink, it is required that an UV-ray light source can emit light which can properly cure and fix the ink. To enable this, it has been offered that a specific light intensity required for curing the ink is obtained by increasing the electric power to be supplied to the light source and thus increasing the emission intensity per unit time of the light.

[Patent Document 1] TOKKAI No. 2001-310454

[Patent Document 2] TOKKAI No. 2003-145725

However, when emission intensity is increased, the amount of heat generation by the light source is also increased. Especially, the light emission efficiency of a low-output type light source depends on the temperature of the metal cap, of the light source, that discharges electricity and has a characteristic of dropping in light emission efficiency at a too high temperature of the metal cap, and thus the low-output type light source has a problem of difficulty in stably maintaining a light emission efficiency preferable for curing ink. To prevent curing of ink adhering to a nozzle formed surface of a recording head, wherein the curing of ink could occur when light having emitted by the light source reaches the nozzle formed surface, and to prevent a harmful effect, on human health, of leakage of light having been emitted from the light emitting device, the light emitting device is conventionally provided with a cover member or the like that covers the-light source. Accordingly, heat generated by lightning of the light source stays in the space covered by the cover member and the temperature there rises, thus, the temperature of the metal cap rises, and thereby a problem of drop in light emission efficiency of the light source is caused. Particularly, in the case of increasing the emission intensity by arranging a plurality of light sources of a line-tube type, since the metal caps of the light sources are near each other, the metal caps of the light sources located near the central part cause thermal interference to each other, making the problem of drop in light emission efficiency of the light sources more significant.

Therefore, conventionally, consideration has been made on cooling a metal cap with water or the like to maintain the temperature of the metal cap at a constant value. However, in the case of a light source of line-tube type, since metal caps are provided at both ends of a light emitting tube, when a plurality of light sources are provided, in order to water cool the metal caps of all the light sources, it is required to provide a mechanism or the like for circulating cooling water widely on both sides of a light emitting device provided with metal caps, causing a problem of complication and large size of an apparatus to be manufactured.

Further, since a light source is degraded as it is used, it is necessary to properly replace the light source. In the case where an apparatus is provided with a plurality of light sources of a line-tube type, a water cooling mechanism as described above is provided. Accordingly, there is also a problem of requiring painstaking works including replacement of light sources.

Still further, electronic radiation material (emitter) coated on a filament of a metal cap spatters by repeated flickering of a light source, and thereby proceeds blackening of the vicinity of the electrode of the metal cap. As the blackened region grows, the light emission intensity of the vicinity of the metal cap of the light source gradually drops. Thus, in the case of a line tube type, it is possible that a blackened region grows in the entire light emitting tube with elapsed time from when the light source started burning, causes unevenness of the emission intensity of the light source, and disables curing of ink with evenness.

SUMMARY OF THE INVENTION

With the above background, an object of the present invention is to provide an ink-jet recording apparatus that can maintain a constant light emission intensity of a light source with a simple structure, and allows easy replacement of the light source, while realizing miniaturization and reduction in weight of the apparatus.

To solve the above problem, in a first aspect of the invention, an ink-jet recording apparatus comprises a recording head to jet photocurable ink onto a recording medium, wherein the photocurable ink is cured by being exposed to light; a light emitting device having a light source to emit light to cure the photocurable ink, the light source including a light emitting tube and metal caps provided at both ends of the light emitting tube, wherein the light emitting tube has a bent section.

In the first aspect of the invention, ink jetted by the recording head is exposed to light emitted from the light source, the light source having a light emitting tube with a bent section, of the light emitting device, and thus the ink is cured.

Further, the light emitting tube preferably comprises at least two line-shaped tubes and the bent section is curved so as to connect the two line-shaped tubes.

In a second aspect of the invention, the ink-jet recording apparatus of the first aspect is provided in such a way that one metal cap and the other one metal cap, described above, of the light source are arranged on the same side.

In the second aspect of the invention, the light emitting tube is bent, and thereby the metal caps provided at the both ends of the light source are positioned on the same side.

In a third aspect of the invention, the ink-jet recording apparatus of the first or second aspect is provided in such a way that the bent section is formed at a part of the light emitting tube in a vicinity of a joint section that connects the metal cap and the light emitting tube such that the direction of the metal cap is orthogonal to a light emitting plane.

In the third aspect of the invention, the light emitting tube is bent at the above described part thereof, so that the metal cap is directed orthogonal to the light emitting plane.

The light emitting tube preferably further comprises at least two line-shaped tubes and a bent section that is curved so as to connect the two line-shaped tubes.

In a fourth aspect of the invention, the ink-jet recording apparatus of any of the first to third aspects is provided in such a way that the light source is attachable and detachable to and from the light emitting device.

In the fourth aspect of the invention, it is allowed to easily attach and detach the light source.

In a fifth aspect of the invention, the ink-jet recording apparatus of the fourth aspect is provided in such a way that the light source is attachable and detachable to and from the light emitting device by moving the light source approximately parallel to a recording surface of the recording medium.

In the fifth aspect of the invention, it is allowed to easily and smoothly attach/detach the light source to/from the light emitting device by moving the light source in the direction parallel to the recording medium.

In a sixth aspect of the invention, the ink-jet recording apparatus of the fourth or fifth aspect is provided, wherein the light emitting device comprises: a light source cover that has a metal cap restraining member for restraining the position of metal caps and can house the light source in the light source cover; and a lid section that can be freely opened and closed with respect to the light source cover, wherein the lid section has a pressing member to press the metal caps against the metal cap restraining member.

In the sixth aspect of the invention, the light source is housed in the light source cover such that the position of each metal cap of the light source is restrained by the metal cap restraining member, and each metal cap is pressed against the metal cap restraining member by the pressing member arranged at the lid section, the lid section being freely openable/closable with respect to the light source cover, so that the position of each metal cap is fixed.

In a seventh aspect of the invention, the ink-jet recording apparatus of any of the fourth to sixth aspects is provided in such a way that the light emitting device comprises a first light emitting tube restraining member to restrain a position of the light source in a convey direction of the recording medium; and a second light emitting tube restraining member to restrain the position of the light source in a direction orthogonal to the convey direction of the recording medium.

In the seventh aspect of the invention, the position of the light source in the convey direction of the recording medium is restrained by the first restraining member, and the position of the light source in the direction orthogonal to the convey direction of the recording medium is restrained by the second restraining member.

In an eighth aspect of the invention, the ink-jet recording apparatus of any of the first to seventh aspects is provided in such a way that the recording head is a serial print type that jets the ink onto the recording material while the recording head moves in the direction orthogonal to the convey direction of the recording medium.

In the eighth aspect of the invention, image recording is performed by an ink-jet recording apparatus of a serial print type.

In a ninth aspect of the invention, the ink-jet recording apparatus of any of the first to seventh aspects is provided in such a way that the recording head is a line print type that jets the ink from a predetermined fixed position to the recording medium moving in the convey direction of the recording medium.

In the ninth aspect of the invention, image-recording is performed by an ink-jet recording apparatus of a line print type.

In a tenth aspect of the invention, the ink-jet recording apparatus of any of the first to ninth aspects is provided in such a way that the light source is a low pressure mercury lamp.

In the tenth aspect of the invention, ink is cured and fixed, using a low pressure mercury lamp as the light source.

In an eleventh aspect of the invention, the ink-jet recording apparatus of any of the first to tenth aspects is provided, wherein light emitted by the light emitting device is UV-ray.

In the eleventh aspect of the invention, the ink is cured and fixed such that the ink having impacted onto the recording medium is exposed to UV-rays, and thus a certain image is formed.

In a twelfth aspect of the invention, the ink-jet recording apparatus of any of the first to eleventh aspects is provided in such a way that the ink is a cation polymer ink containing a cation polymer compound.

In the twelfth aspect of the invention, image recording is performed, using a UV curing ink of a cation polymer system.

In the first aspect of the invention, the bending of a light emitting tube secures a wide emitting surface so that higher illumination intensity can be maintained even with a decreased number of light sources, compared with the case of using light sources of a line-tube type. Therefore, a smaller number of metal caps is required than the case of using light emitting tubes of a line-tube type, allowing it to reduce thermal interference caused by the nearness between metal caps, and thus the light emission efficiency of a light source is steady to stably cure ink.

Since the number of metal caps is small, the structure of a device for cooling the metal caps is simple, which has an effect that realizes miniaturization and reduction in weight of the apparatus.

Further, in case of performing image recording, if photocurable ink is used, the ink is cured by exposure to a certain light after the jetting of the ink, allowing it to maintain the image quality of a recorded image for a long time. Still further, using photocurable ink for image recording has an effect that enables precise image recording, not only on a recording medium having high ink absorbability, such as paper, but also on a recording medium having low or no ink absorbability.

Each metal cap is positioned at each respective end of a light emitting tube in the case of a light source of a line-tube type. On the other hand, in the second aspect of the invention, metal caps can be arranged at the same end of a light source by-bending a light emitting tube. This has effects that simplifies the cooling mechanism of the metal caps, and allows it to easily detach and attach the light source when replacing it.

In the third aspect of the invention, even in the case where electronic radiation material (emitter) coated on a filament of a metal cap spatters with elapsed time from when the light source started burning, and blackening of the vicinity of the electrode of the metal cap gradually develops, since the light emitting tube is bent downward almost vertically at the each metal cap, blackening does not develop further than the bent section described above. Therefore, the light emission intensity of the light emitting tube is maintained almost constant until the life of the light source ends, having an effect that enables steady light emission free from unevenness of light emission distribution due to elapsed time.

In the fourth aspect of the invention, the attachability and detachability of the lamp source has an effect that enables easy replacing of a light source when the life thereof has come to an end.

In the fifth aspect of the invention, the attachability and detachability of the light source by moving it parallel to a recording medium has an effect that enables easy attachment and detachment of the light source, allowing easy replacing of the light source.

In the sixth aspect of the invention, it is allowed to restrain the position of the light source accurately and easily even in the case of replacing the light source, which has an effect that allows a user to easily replace the light source.

In the seventh aspect of the invention, it is allowed to restrain the position of the light source accurately and easily even in the case of replacing the light source, which has an effect that makes it possible for a user to easily replace the light source.

In the eighth aspect of the invention, there are effects that make the light emission efficiency steady even in the case that the ink-jet recording apparatus is a serial type, allowing steady curing of the ink, and simplify the device configuration for cooling the metal caps, with a fewer number of metal caps, to realize miniaturization and reduction in weight of the apparatus, which has an effect that allows a user to easily replace the light source.

In the ninth aspect of the invention, there are effects that make the light emission efficiency steady even in the case that the ink-jet recording apparatus is a line type, allowing steady curing of the ink, and simplify the device configuration for cooling the metal caps, with a fewer number of the metal caps, to realize miniaturization and reduction in weight of the apparatus, which has an effect that allows a user to easily replace the light source.

In the tenth aspect of the invention, light required for curing the ink can be generated with a low voltage, allowing efficient curing and fixing of the ink with a lower consumption electric power, which has an effect that makes it possible to make the light emission efficiency of the light source steady, and to steadily emit light of an illumination intensity required for curing the ink even in the case of using such a low-output type of light source.

In the eleventh aspect of the invention, the ink is cured and fixed by exposure to UV-ray after the ink has been jetted, which has an effect that enables precise image recording, not only on a recording medium having high ink absorbability, such as paper, but also on a recording medium having low or no ink absorbability.

In the twelfth aspect of the invention, differently from radical polymer ink, polymerization reaction of a cation polymer ink is little disturbed by oxygen in the air, and accordingly, the cation polymer ink is cured in a short time and requires no high output light source for curing the ink. Thus, it is not necessary to mount a large sized light source on the apparatus, and thereby, it is possible to realize miniaturization and reduction in weight of the apparatus and also reduce the cost. Further, even in the case of image recording by curing such an ink with a low output type light source, there is an effect that allows it to make the light emission efficiency of the light source steady, and to steadily emit light of an illumination intensity required for curing the ink even in the case of using such a low-output type of light source.

BRIEF DESCRIPTION OF THE DRAWINGS

FIG. 6*a* is an isometric view, viewed from the upstream side in the sub scanning direction, showing the structure of the UV-ray emitting device shown in FIGS. 3 and 4; and FIG. 6*b* is an isometric view, viewed from the upstream side in the sub scanning direction, showing the state that the light source in FIG. 6*a* is drawn out from the body of the UV-ray emitting device.

DETAILED DESCRIPTION OF THE PREFERRED EMBODIMENT

A first embodiment of the invention will be described below, referring to FIGS. 1 and 2.

Figure 1:
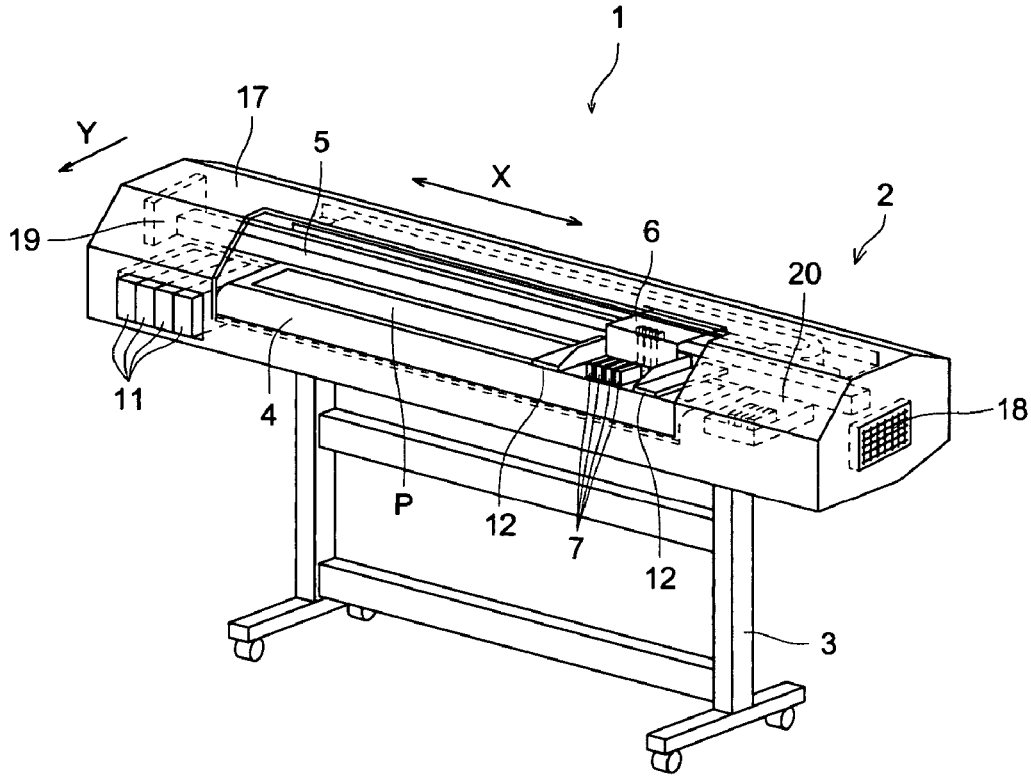
FIG. 1 is an isometric view showing a first embodiment of an ink-jet recording apparatus in accordance with the present invention.

First, as shown in FIG. 1, in the present embodiment, ink-jet recording apparatus 1 is an ink-jet recording apparatus of a serial print type, comprising printer 2 and support table 3 for supporting the printer 2 from under the printer 2. Further, in the central section of the printer 2, platen 4 for supporting recording medium P from the non-recording surface thereof is arranged extending in the longitudinal direction of the printer 2.

Above the platen 4, there is provided guide rail 5 in a rod shape extending in the longitudinal direction of the printer 2. The guide rail 5 supports carriage 6, which is freely and reciprocally movable in main scanning direction X along the guide rail 5 with a driving mechanism (not shown).

Further, the printer 2 is provided with a conveying mechanism (not shown) for conveying the recording medium P in sub scanning direction Y which is orthogonal to the main scanning direction X. The conveying mechanism comprises, for example, a conveying motor and conveying roller, not shown. The conveying roller is rotated by driving the conveying motor to convey the recording medium P along the platen 4 from upstream to downstream in the sub scanning direction Y. When an image is recorded, the conveying mechanism intermittently conveys the recording medium P, repeating conveying and stop of the recording medium P with synchronization with the operation of the carriage 6.

Figure 2:
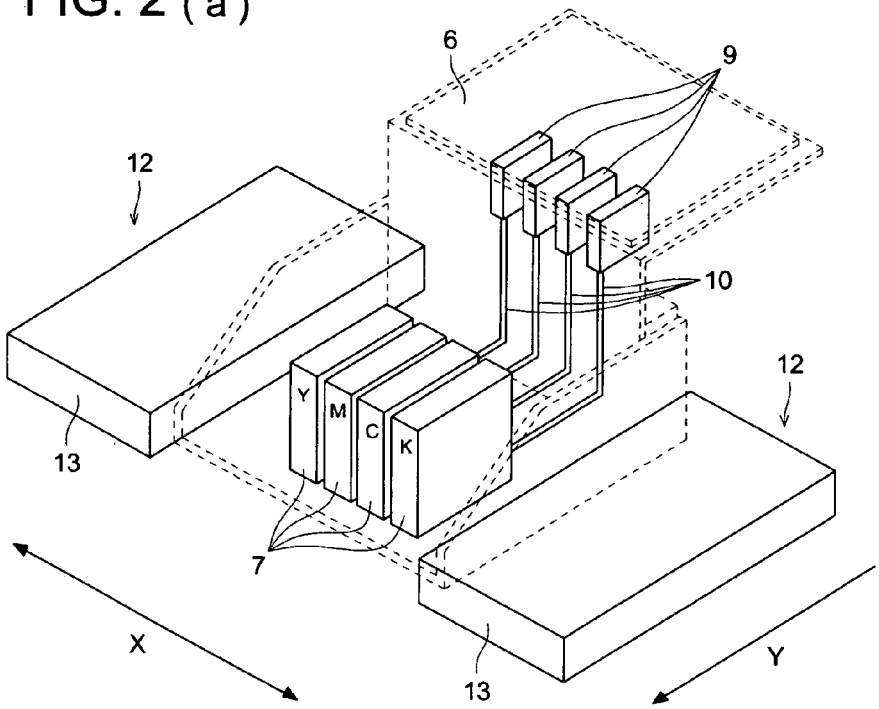
FIG. 2*a* is an isometric view showing a carriage and UV-ray emitting device mounted on the ink-jet recording apparatus shown in FIG. 1.
FIG. 2*b* is an isometric bottom view of the carriage and the UV-ray emitting device of the ink-jet recording apparatus shown in FIG. 2*a;*
Figure 2:
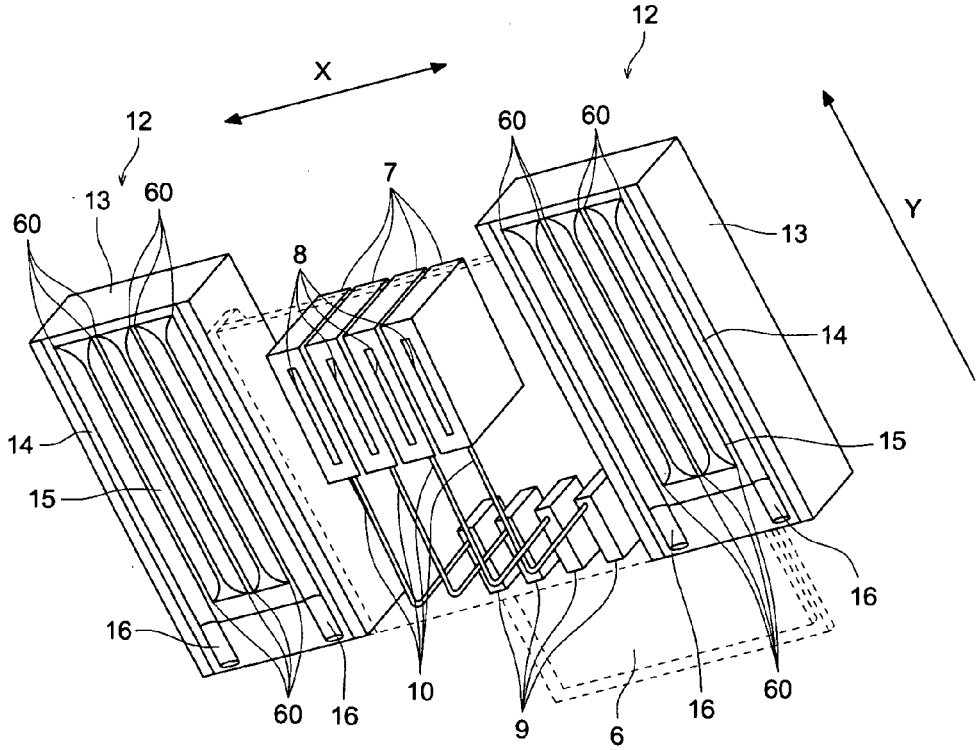

As shown in FIGS. 1 and 2, four recoding heads 7, 7, . . . , which are correspondent to respective colors (yellow (Y), magenta (M), cyan (C), and black (K)) to be used on the ink-jet recording apparatus 1 of the present embodiment, are mounted on the carriage 6. The recording heads 7, 7, . . . have an outer shape formed almost in a rectangular parallelepiped, and are arranged side by side such that the longitudinal directions thereof are parallel to each other. On the surface of each of the recording heads 7, 7, . . . , the surface facing the recording medium P, ink-jetting openings 8, 8, . . . of a plurality of nozzles (not shown) formed on a line along the-longitudinal direction of the recording heads 7, 7, . . . are provided so that the recording heads 7, 7, . . . can jet ink from the respective ink-jetting openings 8, 8, . . . . Incidentally, the inks to be used on the ink-jet recording apparatus are not limited to the above, and, for example, light yellow (LY), light magenta (LM), light cyan (LC), or the like, may also be used. In this case also, recording heads corresponding to the respective colors are mounted on the carriage. Further, the arrangement of nozzles and the shape of jetting openings 8, 8, . . . are not limited to the above examples.

Still further, the carriage 6 is provided with intermediate tanks 9, 9, . . . for supplying ink, in a number corresponding to the respective recording heads 7, 7, . . . , wherein the respective recording heads 7, 7, . . . are connected with the intermediate tanks 8, 8, . . . through ink supply tubes 10, 10 , . . . The intermediate tanks 9, 9, . . . are connected with ink tanks 11, 11, . . . provided at one end of the motion range of the carriage 6, which is outside of the platen 4, through ink supply paths, not shown, wherein inks are, as needed, supplied from the ink tanks 11, 11, . . . to the respective recording heads 7, 7, . . . through the intermediate tanks 9, 9, . . . .

On both sides of the carriage 6, UV-ray emitting devices 12, 12 as light emitting devices are provided in contact with the respective sides of the carriage 6. In the following, description of a single unit of UV-ray emitting device 12 will be given for simplicity. However, it should be understood that the description below is common to the both units of UV-ray emitting devices 12, 12 and members related thereto. The UV-ray emitting device 12 is provided with light source cover 13 having an opening on one end face thereof and formed in a box shape, wherein the opening of the light source cover 13 is arranged facing the recording surface of the recording medium P. Inside the light source cover 13, low pressure mercury lamp 14 is provided as a light source for emitting UV-rays to cure and fix UV-curable ink having impacted onto the recording medium P.

The low pressure mercury lamps 14 is, as shown in FIG. 2*b*, comprised of light emitting tube 15 arranged parallel to the sub scanning direction Y, the tube 15 having a plurality of bent sections 60, 60, . . . at predetermined positions and being bent such that the length of the light emitting tube 15 is greater than the longitudinal length of the recording heads 7, 7, . . . , and cylindrical metal caps 16, 16 are provided at both ends of the light emitting tube 15. By conducting a current between the metal caps 16, 16, the light emitting tube 15 emits light. The shape of the light emitting tube 15 of the low pressure mercury lamp 14 is not limited to one shown in FIG. 2*b*, and it is also allowed to use a type of light emitting tube formed in a U-shape provided with a bent section only at a single portion and fitted with metal caps at both ends of the light emitting tube.

The low pressure mercury lamp 14 has a characteristic of varying UV-ray generation energy depending on the temperature of the metal caps 16, and therefore, the low pressure mercury lamps 14 is arranged to make the UV-ray generation energy even, when the temperatures of the metal caps 16 become a predetermined temperature. To cool the metal caps 16, 16, a cooling fan may be provided in the vicinity of the metal caps 16, 16.

The printer 2 is covered with cover 17 so that the platen 4 and the entire motion range of the carriage 6 are shielded from outside, thereby preventing leakage of light from the UV-ray emitting device 12 to the outside. On one end face of the-cover 17, suction fan 18 for cooling inside the cover 17 by sucking the ambient air is provided. Further, on the other end face of the cover 17, exhausting fan 19 for exhausting the air from inside the cover 17 to outside the cover 17 is provided. In the vicinity of the suction fan 18 for cooling, a cooling mechanism for circulating cooling water, for example, may be provided. In this case, it is possible to supply air having been cooled to a lower temperature than that of the ambient air into inside the cover 17 by the suction fan 18, which enables more effective cooling inside the cover 17.

Further, on the other end of the motion range of the carriage 6, which is the position opposite to the ink tanks 11, 11, . . . with respect to the platen 4, maintenance unit 20 for performing maintenance of the recording heads 7, 7, . . . is arranged.

Each ink used in the present embodiment is photocurable ink having a characteristic of being cured by exposure to UV-ray as light and containing at least a polymer compound (including a known polymer compound), a photoinitiator, and a colorant. Photocurable inks can be broadly categorized into radical polymer inks containing a radical polymer compound as a polymer compound and cation polymer inks containing a cation polymer compound as the same. In the present embodiment, UV-ray curing inks of a cation polymer system which causes difference in curing reaction depending on the humidity and temperature are used. The cation polymer inks used in the present embodiment are a mixture containing, at least: a cation polymer compound such as an oxetan compound, an epoxy compound, a vinyl ether compound, or the like; a photo-cation initiator; and a colorant.

Next, as the recording medium P used in the present embodiment, it is possible to apply recording media of materials such as plain paper applicable to common ink-jet recording apparatuses, recycled paper, gloss paper, other various kinds of paper, various kinds of textile, bonded textile, resin, metal, glass, and others. As the type of the recording medium P, a roll type, a cut-sheet type, a plate type, and the like, can be applied.

Next, the operation of the ink-jet recording apparatus 1 in the present embodiment will be described.

When the operation of image recording is started, ambient air is sucked inside the cover 17 by the operation of the suction fan 18, while the air inside the cover 17 is exhausted outside the cover 17 by the operation of the exhausting fan 19. Thus, air inside the cover 17 and ambient air circulate, thereby, the temperature inside the cover 17 is conditioned to be approximately the same as that of the ambient air, and thus the temperature of the metal caps 16, 16 of the low pressure mercury lamp 14 provided on the UV-ray emitting device 12 is maintained to a predetermined temperature.

When the recording medium P is conveyed in the sub scanning direction Y by the conveying mechanism and reaches a predetermined position of the platen 4, the carriage 6 reciprocally moves along the guide rail 5, while required inks are jetted from the ink-jetting openings 8, 8, . . . of the recording head 7, 7, . . . , according to a certain image data. Simultaneously, the low-pressure mercury lamp 14 of the UV-ray emitting device 12 starts burning, UV-rays are emitted to the inks having been jetted onto the recording medium P, thereby, the inks are cured and fixed, and thus an image is recorded on the recording surface of the recording medium P.

When ink has adhered to the ink-jetting openings 8, 8, . . . of the recording heads 7, 7, . . . , a maintenance work is performed on the ink-jetting openings 8, 8, . . . by the maintenance unit 20.

As described above, in the present embodiment, the printer 2 is covered with the cover 17 so that UV-rays emitted by the UV-ray emitting device 12 do not leak outside, thereby allowing it to safely perform image recording operation even in indoor environment in office, for example. Further, since the suction fan 18 and the exhausting fan 19 are provided on the respective sides of the cover 17 so that air inside the cover 17 and ambient air circulate, the temperature inside the cover 17 does not rise excessively, making it possible to cure and fix ink by exposure to UV-ray safely all the time and realize image recording in a high image quality.

Further, since the light emitting tubes 15, which is the light source, of the low-pressure mercury lamp 14 is bent, light for the same illumination intensity as that in the case of providing a plurality of line-type light sources can be emitted by a single low-pressure mercury lamp 14. Therefore, the number of metal caps 16, 16 arranged inside the UV-ray emitting device can be decreased, and thus it is possible to prevent a drop in the light emission efficiency of the low-pressure mercury lamp 14 caused by thermal interference between the metal caps 16, 16.

Although, in the present embodiment, the cover 17 is arranged to cover the entire printer 2, the cover 17 is essentially required to prevent leakage of UV-rays emitted by the UV-ray emitting devices 12, 12 to outside. Therefore, for example, the cover 17 may be arranged to cover only the UV-ray emitting devices 12, 12 and the recording heads 7, 7, . . . , or, it is also allowed to cover the entire ink-jet recording apparatus 1 and perform image recording in a sealed space.

Further, in the present embodiment, as described above, in the case of the ink-jet recording apparatus 1, the ink-jet recording apparatus 1 being applied with the recording heads 7, 7, . . . , of the invention, the recording heads 7, 7, . . . mounted on the carriage 6 are reciprocally moved in the main scanning direction X, while the recording medium P is conveyed in the sub scanning direction Y and the recording heads 7, 7, . . . are controlled to jet inks during the conveyance of the recording medium P. Thus, the ink-jet recording apparatus 1 of a serial head type forms an image. However, it is also possible to apply the invention to an ink-jet recording apparatus of a line head type, wherein inks are jetted from recording heads which are fixed to a printer, while a recording medium is conveyed, thereby forming an image.

Still further, although, in the present embodiment, the low-pressure mercury lamps 14, 14 are used as the light sources of the UV-ray emitting devices 12, 12, the light sources are not limited to these, and it is also possible to apply, for example, high-pressure mercury lamps, metal halide lamps, hot-cathode tubes, cold-cathode tubes, excimer lamps, UV-ray lasers, LEDs (Light Emitting Diodes), etc.

In the present embodiment, the UV-ray emitting devices 12, 12 are provided with the respective low-pressure mercury lamps 14, 14, in other words, each UV-ray emitting device is provided with a single low-pressure mercury lamp. However, the quantities of the low-pressure mercury lamps 14, 14 arranged on the UV-ray emitting devices 12, 12 are not limited to this, and a plurality of lamps may be provided for each.

Still further, although, in the present embodiment, image recording is performed using inks curable by exposure to UV-rays, the types of inks are not limited to these, and it is also possible to use, for example, inks curable by exposure to light other than UV-rays, such as electron beams, X-rays, visible light, infrared rays, etc. In this case, the inks are applied with a polymer compound that polymerizes and gets cured by light other than UV-rays, and a photo-initiator that initiates a polymerization reaction between polymer compounds by light other than UV-rays. In case of using photocurable inks curable by light other than UV-rays, light sources that emit this type of light are applied instead of the UV-ray light sources.

In other respects, it is of course possible to properly change or modify the embodiment of the invention without being limited to the above embodiment.

Next, a second embodiment of an ink-jet recording apparatus according to the invention will be described, referring to FIGS. 3 to 6*b*. As the second embodiment is different from the first embodiment only in the structure of a UV-ray emitting device, the structure of the UV-ray emitting device will be particularly described in the following.

Figure 3:
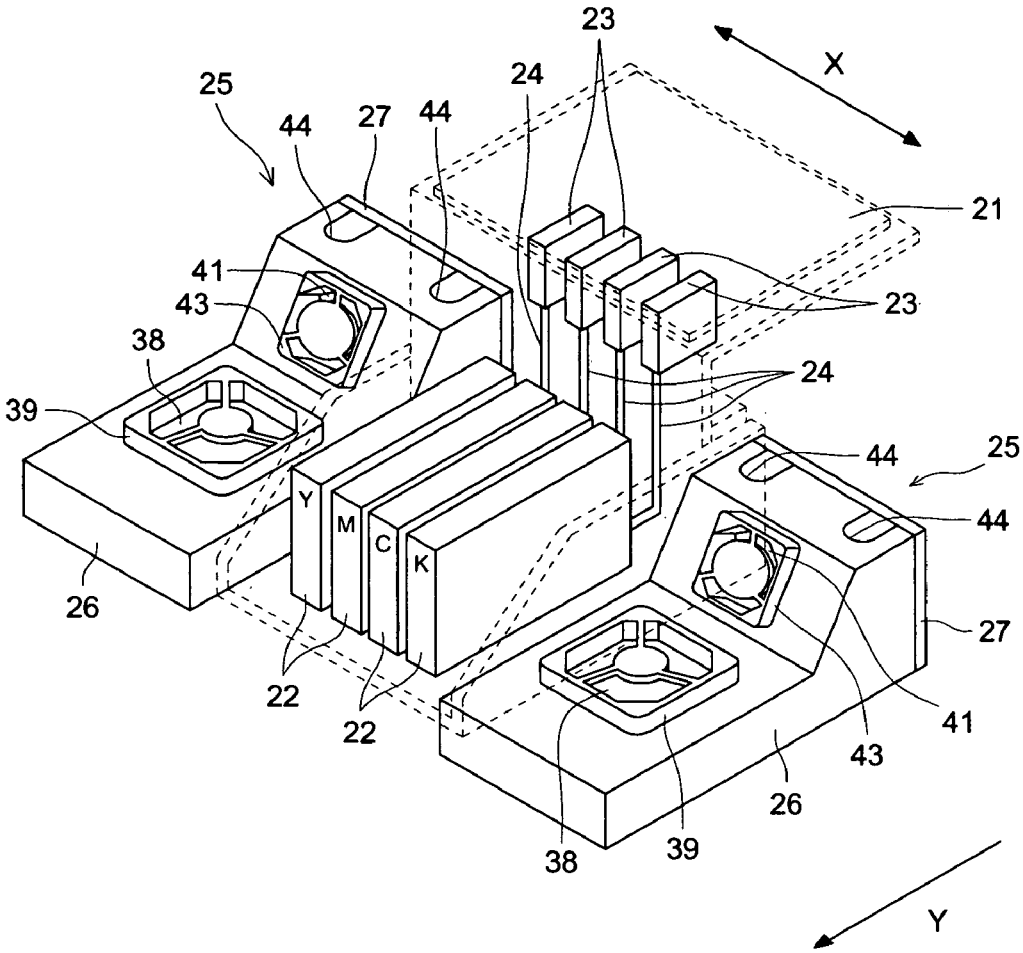
FIG. 3 is an isometric view showing the structure of a carriage and UV-ray emitting device mounted on an ink-jet recording apparatus in accordance with a second embodiment of the invention.
Figure 4:
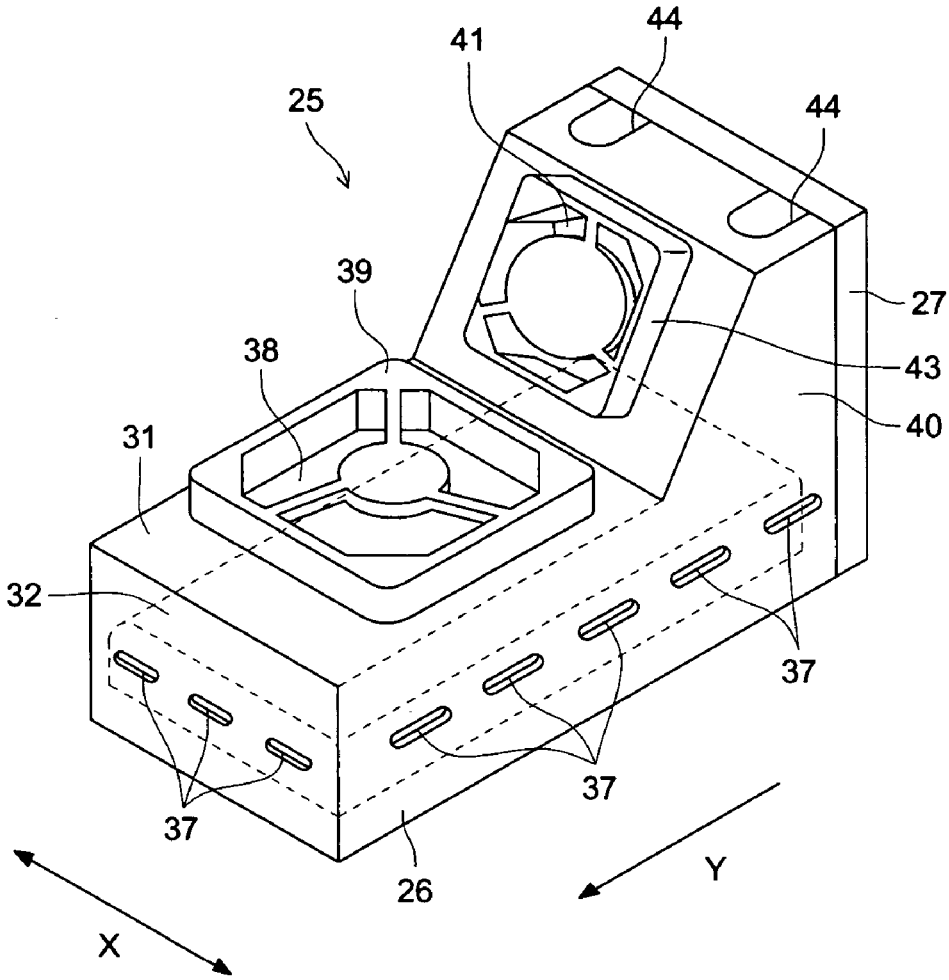
FIG. 4 is an isometric top view showing the structure of the UV-ray emitting device mounted on the ink-jet recording apparatus in accordance with the second embodiment of the invention.
Figure 5:
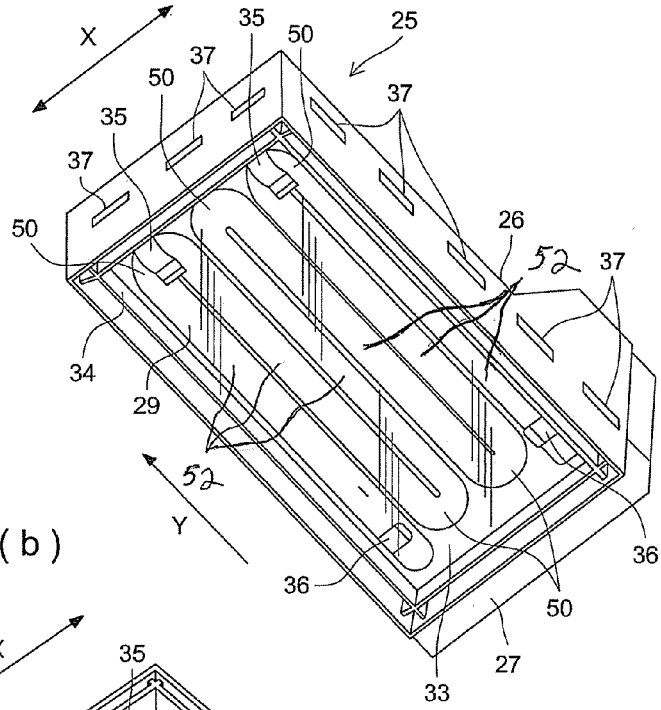
FIG. 5*a* is an isometric bottom view showing the structure of the UV-ray emitting device shown in FIGS. 3 and 4.
FIG. 5*b* is an isometric bottom view showing the state that a light source shown in FIG. 5*a* is drawn out from the body of the UV-ray emitting device.
Figure 5:
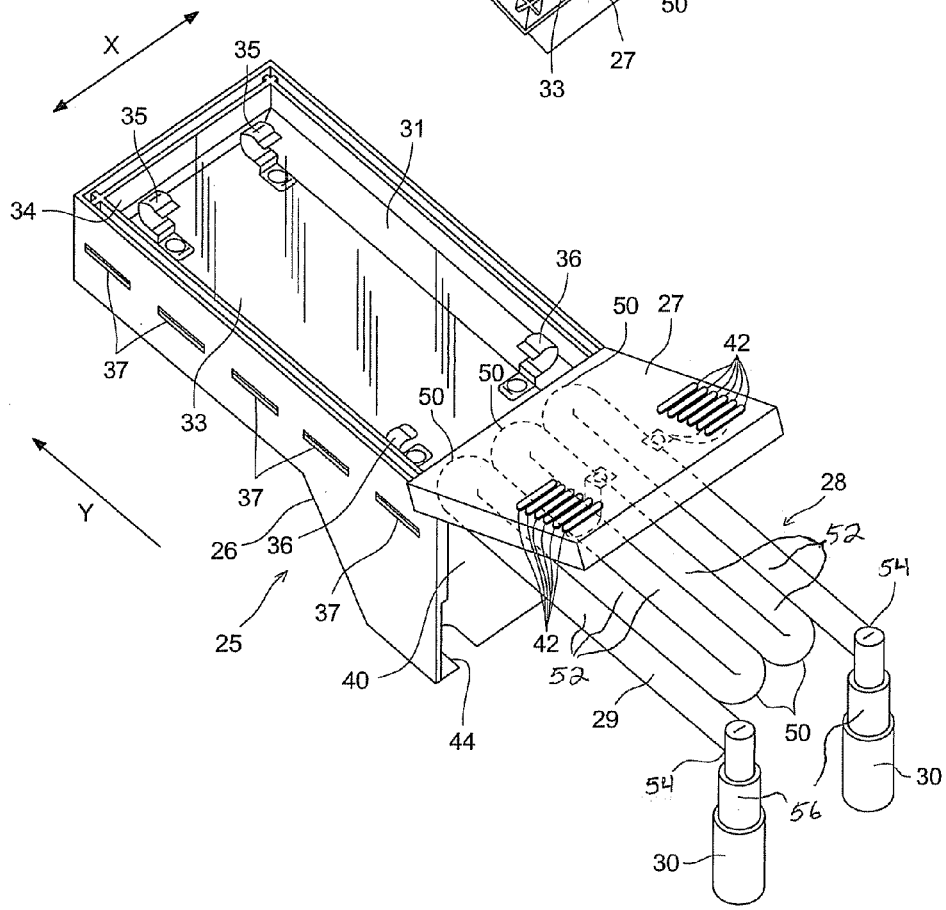

An ink-jet recording apparatus of the present embodiment is, likewise in the first embodiment, a serial head type ink-jet recording apparatus provided with, as shown in FIG. 3, carriage 21 having mounted thereon recording heads 22, 22, . . . which jet inks in the respective colors of yellow (Y), magenta (M), cyan (C), and black (K) onto recording medium P. The carriage 21 is designed to reciprocally move along a guide rail (not shown) in a main scanning direction X by a driving mechanism (not shown).

The recording heads 22, 22, . . . are respectively connected with intermediate tanks 23, 23, . . . which store inks in the respective colors through ink supply tubes 24, 24, . . . .

On both sides, with respect to the main scanning direction X, of the recording heads 22, 22, . . . , UV-ray emitting devices 25, 25 are provided as light emitting devices for curing ink having been jetted onto recording medium P by emitting UV-rays to the ink.

In the following, description of a single unit of UV-ray emitting device 25 will be given for simplicity. However, it should be understood that the description below is common to the both units of the UV-ray emitting devices 25, 25 and members related thereto. As shown in FIGS. 3 to 6*b*, the UV-ray emitting device 25 has a box shape which is opened toward the side of recording medium P, and has light source cover 26 of which the end on the upstream side in sub scanning direction Y protrudes upward. The UV-ray emitting devices 25 is provided with lid section 27 fitted on the end on the upstream side, in the sub scanning direction Y, of the light source cover 26 through a hinge mechanism, not shown, arranged at the bottom section of the light source cover 26. The lid section 27 is freely openable and closable with respect to the light source cover 26 by rotation around the bottom section of the light source cover 26 as a rotation axis. The structure for opening and closing the lid section 27 is not limited to the example shown. Further, the lid section 27 may be arranged such that the lid section 27 opens and closes by rotation around a portion other than the bottom section of the light source cover 26 as the rotation axis, for example, applying the top end section of the light source cover 26 as the rotation axis.

In the light source cover 26, as shown in FIGS. 5*a* and 5*b*, low-pressure mercury lamp 28 is housed as a light source for emitting UV-ray to cure the inks.

The low-pressure mercury lamp 28 is arranged in the sub scanning direction Y, and comprises light emitting tube 29. The light emitting tube 29 has a plurality of bent sections 50, 50, . . . at predetermined positions. Each of the bent sections 50, 50, . . . connects two straight portions 52, 52, . . . of the tube 29 to make a turn between them. The light emitting tube 29 is bent such that the length thereof is preferably greater than the longitudinal length of the recording heads 22, 22, . . . . The light emitting tube 29 further has bent end sections 54, 54 on the same side of the light source, namely, the lamp 28. The lamp 28 further comprises cylindrical metal caps 30, 30 fitted at both ends of the light emitting tube 29. The metal caps 30, 30 has a filament, not shown, coated with an electronic radiating material (emitter), wherein a current is conducted though the metal caps 30, 30 so as to cause the light emitting tube 29 to emit light. Each light emitting tube 29 has bent end sections 54, 54 bent approximately at a right angle, adjacent to the respective joint sections 56, 56 connected with the metal caps 30, 30. Herein, the portions of the light emitting tube 29 after the bent end sections 54, 54 and the metal caps 30, 30 along the protrusion of the light source cover 26, extend upward and are approximately orthogonal to the recording surface of the recording medium P. The same as in the first embodiment, the shape of the light emitting tube 29 of the low-pressure mercury lamp 28 is not limited to the shape shown in FIGS. 5*a* and 5*b*.

A portion of the light source cover 26 on the downstream side in the sub-scanning direction Y is arranged as a light emitting tube housing section 31 for housing the light emitting tube 29. Inside the light emitting tube housing section 31, reflecting member 32 for reflecting, onto the recording medium P, UV-rays having been emitted and diffused from the light emitting tube 29 is provided, the reflecting member 32 covering the light emitting tube 29. As the reflecting member 32, a reflecting plate of aluminum of a high purity which efficiently reflects UV-rays in the entire wavelength range is applied, for example. Particularly, a cold mirror (formed glass plate) which is made by vapor depositing of a thin film of a metal compound principally containing aluminum is preferable because it efficiently reflects UV-rays, while it transmits visible light and infrared rays, which do not contribute to curing of ink, behind the mirror, thereby reducing a drop in light emission efficiency due to heat generation by the light emitting tube 29.

As shown in FIGS. 5*a* and 5*b*, at the bottom of the light emitting tube housing section 31, the bottom facing the recording medium P, there is provided a protection member 33 for preventing adherence of dirt, such as ink mist, to the light emitting tube 29 and preventing the recording medium P from contacting the light emitting tube 29 when the recording medium P floats off a platen (not shown) due to convey failure. The protection member 33 is supported by frame-shaped supporting member 34 provided along the inner surface at the bottom of the light source cover 26. The protection member 33 is formed of a material such as transparent glass or transparent resin in a plate shape, and is replaceable. For the protection member 33, normal silica glass, synthetic silica glass, or the like, which efficiently transmits the UV-ray wavelength range, and particularly, UV-C range (up to 280 nm), is preferably employed.

In one end region inside the light emitting tube housing section 31 on the downstream side in the sub scanning direction Y, sub scanning direction restraining member 35 is arranged as a first light emitting tube restraining member for restraining the position of the low-pressure mercury lamp 28 in the sub scanning direction Y when the low-pressure mercury lamp 28 is received by the light source cover 26. Further, at both side regions, in the main scanning direction X, inside the light emitting tube housing section 31, main scanning direction restraining member 36 is arranged as a second light emitting tube restraining member for restraining the position of the low-pressure mercury lamp 28 in the main scanning direction X when the low-pressure mercury lamp 28 is received by the light source cover 26. The sub scanning direction restraining member 35 and the main scanning direction restraining member 36 are formed, foe example, of a metal plate having spring characteristics. Incidentally, the material of the sub scanning direction restraining member 35 and the main scanning direction restraining member 36 is not limited to the example, shown here, and it is possible to apply any material having spring characteristics and an enough heat resistance against the heat generated by the light emitting tube 29.

On each side face, of the light source cover 26, which serves as a part of the light emitting tube housing section 31, there is provided a plurality of ambient air inlet openings 37, 37, . . . for feeding ambient air into the light emitting tube housing section 31. On the top face of the light source cover 26 which serves as a part of the light emitting tube housing section 31, there is provided an air exhausting opening 38 for exhausting air from the light emitting tube housing section 31. At the position corresponding to the air exhausting opening 38 on the top face of the light source cover 26, there is arranged light emitting tube cooling fan 39 for releasing heat generated by the light emitting tube 29 and cooling the light emitting tube 29 by taking in the ambient air from the ambient air inlet openings 37 and exhausting air from the air exhausting opening 38 with rotation drive.

The protrusion of the light source cover 26 is used as metal cap housing section 40 for housing the metal caps 30. On the side face, of the metal cap housing section 40, on the downstream side in the sub scanning direction Y, there is arranged ambient air feeding opening 41 for feeding ambient air into the metal cap housing section 40. Further, on a face of the lid section 27, air exhausting slits 42, 42, . . . are provided to exhaust air from the metal cap housing section 40.

At the position, the position corresponding to the ambient air feeding opening 41, on the side face of the metal cap housing section 40, the side face being on the downstream side in the sub scanning direction Y, there is provided a metal cap cooling fan 43 for releasing heat and cooling the metal caps 30, 30 by feeding the ambient air from the ambient air feeding opening 41 and exhausting air from the air exhausting slits 42 with rotation drive. This metal cap cooling fan 43 is arranged such that the rotation velocity thereof is variable by changing the voltage applied to a drive motor for rotationally driving the fan.

As shown in FIGS. 6*a* and 6*b*, at the positions on the top face of the metal cap housing section 40, the positions corresponding to those of the metal caps 30, 30 when the low-pressure mercury lamp 28 is received by the light source cover 26, cutout sections 44, 44 for connecting terminals, not shown, to the metal caps 30, 30 are formed. The terminals are connected through these cutout sections 44, 44, thus electric power is supplied to the metal caps 30, 30, and thereby UV-rays are emitted by the light emitting tube 29.

In the light source cover 26, between the light emitting tube housing section 31 and the metal cap housing section 40, plate-shaped body-side partition member 45, having heat insulation characteristics, to part these two sections is arranged. At the positions on the body-side partition member 45, the positions corresponding to those on the light emitting tube 29, there are respectively formed cutout sections 45*a*, 45*b* for receiving the end sections, on the light emitting tube 29 side, of the metal caps 30, 30, wherein the end sections, on the light emitting tube 29 side, of the metal caps 30, 30 contact these cutout sections 45*a* and 45*b*. Further, at the position on the lid section 27, the position corresponding to that of the body-side partition member 45, there is arranged plate-shaped lid-side partition member 46, having heat insulation characteristics, to part the light emitting tube housing section 31 and the metal cap housing section 40. At the positions on the lid-side partition member 46, the positions corresponding to those on the light emitting tube 29, there are respectively formed cutout sections 46*a*, 46*b* for receiving the end sections, on the light emitting tube 29 side, of the metal caps 30, 30, wherein the end sections, on the light emitting tube 29 side, of the metal caps 30, 30 contact these cutout sections 46*a* and 46*b*. When the lid section 27 closes the light source cover 26, the body-side partition member 45 and the lid-side partition member 46 serve as partition members to part the light emitting tube housing section 31 and the metal cap housing section 40.

Further, on the respective side walls, on the both sides in the main scanning direction X, of the metal cap housing section 40, metal cap restraining member 47 for restraining the positions of the metal caps 30, 30 is provided, wherein the metal cap restraining member 47 is formed along the circumferential surface, on the downstream side in the sub scanning direction Y, of the metal caps 30, 30.

Further, at the positions on the inner surface of the lid section 27, the positions being correspondent to those of the metal caps 30, 30 when the lid section 27 is closed, press member 48 for pressing the metal caps 30, 30 against the restraining member 47 is arranged, thereby fixing the metal caps 30, 30. The press member 48 is formed of, for example, a metal plate or the like, having spring characteristics. The material that forms the press member 48 is not limited to the example described here, and it is possible to apply any material having spring characteristics.

Still further, at a position on the body-side partition member 45 and in the vicinity of a metal cap 30, metal cap temperature sensor 49 for detecting the temperature of the metal cap 30 is provided.

Yet further, the ink-jet recording apparatus 1 comprises a control section (not shown) for controlling the operations of the light emitting tube cooling fans 39, 39, metal cap cooling fans 43, 43, and the like. To this control section, detection results are transmitted from the metal cap temperature sensors 49, 49. According to detection results of the metal cap temperature sensors 49, 49, the control section controls the rotation velocities of the metal cap cooling fans 43, 43 so that the temperatures of the metal caps 30, 30 are maintained to a predetermined temperature.

Further, when performing recording operation, the control section rotationally drives the light emitting tube cooling fans 39, 39 at a predetermined time after the low-pressure mercury lamps 28, 28 start burning. When the recording operation is terminated and the low-pressure mercury lamps 28, 28 are turned off, the control section stops the rotation of the light emitting tube cooling fans 39, 39.

As other structures are the same as those in the first embodiment, the same reference symbols are given to the same sections of which description will be omitted.

Next, the functions of the ink-jet recording apparatus 1 in the present embodiment will be described below.

After image recording operation is started, the recording medium P is conveyed in the sub scanning direction Y by a conveying mechanism. When the recording medium P reaches a predetermined position, the carriage 21 reciprocally moves along a guide rail, and required ink is jetted, according to certain image data, from the nozzles of the recording heads 22, 22, . . . . Simultaneously, the low-pressure mercury lamps 28, 28 of the UV-ray emitting devices 25, 25 start burning and emit UV-rays onto the ink-jetted on the recording medium P, thereby curing and fixing the ink to record an image on the recording surface of the recording medium P.

At this time, as a high power is supplied to the metal caps 30, 30, the temperatures of the metal caps 30, 30 and the light emitting tubes 29, 29 rise. However, the temperatures of the metal caps 30, 30 are detected all the time by the metal cap temperature sensors 49, 49. According to the detected temperatures, the rotation velocities of the metal cap cooling fans 43, 43 are controlled by the control section, and thus the temperatures of the metal caps 30, 30 are adjusted to a predetermined temperature.

At a predetermined time after the low-pressure mercury lamps 28, 28 start burning, the control section starts the light emitting tube cooling fans 39, 39 rotating. Thus, the light emitting tubes 29, 29 are cooled, not partially, but uniformly as a whole, which adjusts the temperature difference between the light emitting tubes 29, 29 and the metal caps 30, 30 to be in the range of temperature difference that allows high light emission efficiency.

As image recording and flickering of the low-pressure mercury lamps 28, 28 are repeated, the electronic radiation material (emitter) coated on the filaments of the metal caps 30, 30 spatters, and the vicinities of electrodes of the metal caps 30, 30 gradually turn black. However, since each light emitting tube 29 has bent sections 50, 50 below the metal caps 30, 30, blackening does not extends further than the bent sections 50, 50, and thus, the illumination intensity by the light emitting tube 29 housed in the light emitting tube housing section 31 is maintained almost constant.

When replacing a low-pressure mercury lamp 28, a user, first opens the lid section 27 of a UV-ray emitting device 25 that requires replacement of the low-pressure mercury lamp 28, draws out the low-pressure mercury lamp 28 housed in the light source cover 26 from the downstream side to the upstream side in the sub scanning direction Y, and takes out the low-pressure mercury lamp 28 from the light source cover 26. Next, with the lid section 27 opened, the user inserts a new low-pressure mercury lamp 28 into the light source cover 26 from the upstream side to the down stream side in the sub scanning direction. At this time, if the user inserts the low-pressure mercury lamp 28 to the deep in the light source cover 26, the tip section of the light emitting tube 29 is held by the sub scanning direction restraining member 35 so that the position of the low-pressure mercury lamp 28 in the sub scanning direction Y is restrained.

Simultaneously, the main scanning direction restraining member 36 holds the both sides of the light emitting tube 29, and the position of the low-pressure mercury lamp 28 in the main scanning direction X is restrained. Further, the metal caps 30, 30 contact the restraining member 47, while the light emitting tube 29 connected to the metal caps 30, 30 contacts the body-side partition member 45. When the user closes the lid section 27, the press member 48 arranged on the lid section 27 presses the metal caps 30, 30 against the restraining member 47, thereby fixing the metal caps 30, 30. Still further, when the lid section 27 is closed, the body-side partition member 45 and the lid-side partition member 46 are combined, and thus, the light emitting tube housing section 31 and the metal cap housing section 40 are parted.

As described above, because the metal caps 30, 30 are not excessively close to each other, the ink-jet recording apparatus 1 causes thermal interference little, maintains the light emission efficiency in fine condition, and cures ink with stable output of UV-rays. Therefore, fine images can be stably obtained.

Further, when the life of a low-pressure mercury lamp 28 comes to an end, it is easy to replace it.

Still further, blackening of the vicinities of the electrodes of the metal caps 30, 30 caused by spattering of electronic radiation material (emitter) coated on a filament of metal caps 30, 30 does not extend further than the bent sections. Therefore, it is possible to emit light, maintaining the illumination intensity by each light emitting tube 29 housed in the light emitting tube housing section 31 almost constant.

In the present embodiment, the invention is applied to the ink-jet recording apparatus 1 of a serial head type that records an image in such a way that the recording heads 22, 22, . . . mounted on the carriage 21 are reciprocally moved in the main scanning direction X, and the recording medium P is conveyed in the sub scanning direction Y, wherein ink is jetted from the recording heads 22, 22, . . . . However, the invention can also be applied to an ink-jet recording apparatus of a line head type that forms an image in such a way that ink is jetted from recording heads which are provided for the entire width of a recording medium P and fixed above the recording medium P, and the recording medium P is conveyed in a direction orthogonal to the recording heads.

In this case, for example, a light emitting device is arranged on the downstream side, in the conveyance direction of the recording medium, with respect to the recording heads, and parallel to the longitudinal direction of the recording heads. Further, for example, a lid section can be arranged at either end of the light emitting device and opened and closed so that a low-pressure mercury lamp can be replaced by moving it in the direction orthogonal to the conveyance direction of the recording medium. In the case of a line head type ink-jet recording apparatus, the position of arranging a lid section is not limited to this shown here as an example, and a low-pressure mercury lamp may be replaced in such a way, for example, that a lid section is arranged on a side face, of a light emitting device, which does not face recording heads, the lid section is opened and closed, and the low-pressure mercury lamp is moved in the conveyance direction of a recording medium.

In the present embodiment, the user opens the lid section 27 provided at a portion, of the light source cover 26, on the upstream side in the sub scanning direction Y so as to draw out the low-pressure mercury lamp 28 housed in the light source cover 26 from the downstream side to the upstream side in the sub canning direction Y, and thus takes out the low-pressure mercury lamp 28 from inside the light source cover 26. However, the direction in which the low-pressure mercury light 28 is drawn out is not limited to this. For example, a lid section 27 may be arranged on the side face of a light source cover 26 so that a low-pressure mercury lamp 28 is drawn out in the main scanning direction X. Or, lid section 27 may be arranged on a portion, of light source cover 26, on the downstream side in the sub scanning direction Y so that low-pressure mercury lamp 28 is drawn out from the upstream side to the downstream side in the sub scanning direction Y.

Still further, although, in the present invention, a cooling fan is employed as a means for cooling the metal caps 30, 30 and each light emitting tube 29, the means for cooling the metal caps 30, 30 and each light emitting tube 29 is not limited to this.

For example, instead of each metal cap cooling fan 43, a Peltier module which is made by serially and electrically connecting a plurality of Peltier devices, which are thermoelectric cooling devices, may be arranged through a thermal conducting section that is made of a material with a high thermal conductivity, the thermal conducting section covering around the two metal caps 30, 30. A direct current is applied to the Peltier devices from a power supply section so that the Peltier module absorbs heat from a face of the Peltier devices and releases heat from another face, wherein it is possible to switch the cooling face and the heat releasing face by reversing the direction of the current applied to the Peltier devices. Further, it is possible to provide a heat sink on a surface facing a heat-conducting section contact-surface which is in contact with the heat-conducting section of the Peltier module, wherein the heat sink releases heat having been absorbed from a cooling surface and transferred when the heat-conducting section contact-surface functions as the cooling surface, and it is also possible to provide a cooling fan, on the top of the heat sink, for diffusing the heat radiated from the heat sink. In this case, it is desirable to arrange the Peltier module such that the Peltier module contacts the circumferential surfaces of the metal caps 30, 30 on the downstream side in the sub scanning direction so that the, Peltier module does not disturb replacement of the low-pressure mercury lamp 28.

Likewise, it is also possible to provide, instead of a light emitting tube cooling fan 39, a Peltier module through a plate-shaped heat-conducting section made of a material with a high thermal conductivity on the top of the reflecting member 32, and control the heat motion by the Peltier module, according to the temperature of the light emitting tube 29.

It is also possible to provide a water jacket in contact with the metal caps 30, 30 and a water cooling tank for supply of cooling water to the water jacket. In this case, temperature control can be performed by controlling the supply amount of the cooling water. Likewise, it is also possible to provide a water jacket on the top of the reflecting member 32 to supply cooling water, thereby adjusting the temperature of the light emitting tube 29. Also in this case, it is desirable to arrange the water jacket for cooling the metal caps 30, 30 such that the water jacket contacts the circumferential surfaces of the metal caps 30, 30 on the downstream side in the sub scanning direction so that the water jacket does not disturb replacement of the low-pressure mercury lamp 28.

In the present embodiment, one end, in the sub scanning direction Y, of each light source cover 26 is formed protruding upward; the metal caps 30, 30 are extended upward along the protrusion of the light source cover 26 from the both ends of the light emitting tube 29; and the protrusion is used as the metal cap housing section 40 for housing the metal caps 30, 30. However, the shape of the light source cover 26 is not limited to this, and it is possible, for example, to form a light source cover 26 into a box-shape without forming a protrusion, and to provide metal caps in the sub scanning direction Y. Further, it is possible to provide a metal cap cooling fan and a light emitting tube cooling fan respectively at the positions corresponding to the metal cap receiving section and the light emitting tube receiving section which are in the upper portion of the light source cover and parted by the partition members. Still further, if ink-jetted from the recording heads 22, 22, . . . and others are not affected by air exhausting, air exhausting and air absorbing may be reversed.

The invention is not limited to the present embodiment, the same as in the case of the first embodiment.

What is claimed is:

1. An ink-jet recording apparatus, comprising:

a recording head to jet photocurable ink onto a recording medium, wherein the photocurable ink is cured by being exposed to light; and a light emitting device having a light source to emit light to cure the photocurable ink, the light source comprising a light emitting tube and metal caps provided at both ends of the light emitting tube, the both ends being on a same side of the light source, wherein the light emitting tube comprises:

at least two straight portions;

at least one bent section for connecting the two straight portions to make a turn between the two portions; and two bent end sections, each of which is formed adjacent to a joint section that connects the respective end of the light emitting tube and the respective metal cap such that a portion of the light emitting tube from the bent end section to the end is approximately orthogonal to a recording surface of the recording medium.

2. The ink-jet recording apparatus of claim 1, wherein, the light source is attachable and detachable to and from the light emitting device.

3. The ink-jet recording apparatus of claim 2, wherein, the light source is attachable and detachable to and from the light emitting device by moving the light source approximately parallel to the recording surface of the recording medium.

4. The ink-jet recording apparatus of claim 2, wherein, the light emitting device comprises:

a light source cover that has a metal cap restraining member for restraining the position of the two metal caps and can house the light source therein; and a lid section that can be freely opened and closed with respect to the light source cover, wherein, the lid section has a pressing member for pressing the metal caps against the metal cap restraining member.

5. The ink-jet recording apparatus of claim 2, wherein, the light emitting device comprises:

a first light emitting tube restraining member for restraining a position of the light source in a convey direction of the recording medium; and a second light emitting tube restraining member for restraining the position of the light source in a direction orthogonal to the convey direction of the recording medium.

6. The ink-jet recording apparatus of claim 1, wherein, the recording head is a serial print type that jets the ink onto the recording material while the recording head moves in the direction orthogonal to the convey direction of the recording medium.

7. The ink-jet recording apparatus of claim 1, wherein, the recording head is a line print type that jets the ink from a predetermined fixed position to the recording medium moving in the convey direction.

8. The ink-jet recording apparatus of claim 1, wherein, the light source is a low pressure mercury lamp.

9. The ink-jet recording apparatus of claim 1, wherein, light emitted by the light emitting device is UV-ray.

10. The ink-jet recording apparatus of claim 1, wherein, the ink is a cation polymer ink containing a cation polymer compound.

* * * * *